US009421538B1

(12) United States Patent
Sung

(10) Patent No.: US 9,421,538 B1
(45) Date of Patent: Aug. 23, 2016

(54) PIPETTE

(71) Applicant: Wistron Corporation, New Taipei (TW)

(72) Inventor: Chen-An Sung, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/855,360

(22) Filed: Sep. 15, 2015

(30) Foreign Application Priority Data

Jun. 9, 2015 (TW) ..... 104118579 A

(51) Int. Cl.
*B01L 3/00* (2006.01)
*B01L 3/02* (2006.01)

(52) U.S. Cl.
CPC ..... *B01L 3/021* (2013.01); *B01L 2300/0832* (2013.01); *B01L 2300/0848* (2013.01); *B01L 2300/0858* (2013.01); *B01L 2300/0861* (2013.01)

(58) Field of Classification Search
None
See application file for complete search history.

(56) References Cited

U.S. PATENT DOCUMENTS 6,423,237 B1 * 7/2002 Guirguis ..... A61B 10/0045 210/416.1
8,192,699 B2 6/2012 Ziegmann
8,821,796 B2 * 9/2014 Peng ..... G01N 33/48721 422/501
8,999,726 B2 * 4/2015 Chang-Yen ..... B01J 19/0046 422/408
2007/0062583 A1 * 3/2007 Cox ..... B01L 3/502715 137/565.01
2011/0112503 A1 * 5/2011 Ismagilov ..... B01L 3/502715 604/500
2014/0308671 A1 * 10/2014 McGuire ..... B01L 3/0293 435/6.12
2014/0309661 A1 * 10/2014 Sheps ..... A61M 25/0068 606/130
2014/0349387 A1 * 11/2014 Davies ..... B01L 3/021 435/309.1
2014/0377147 A1 * 12/2014 Sammler ..... B01L 3/0275 422/513
2015/0352579 A1 * 12/2015 Burrowes ..... B05B 11/3001 239/304

FOREIGN PATENT DOCUMENTS

WO 0102095 A1 1/2001

OTHER PUBLICATIONS

Office action mailed on Jan. 18, 2016 for the Taiwan application No. 104118579, filing date: Jun. 9, 2015, p. 1 line 12-14, p. 2 and p. 3 line 1-9.

* cited by examiner

*Primary Examiner* — Jill Warden
*Assistant Examiner* — Brittany Fisher
(74) *Attorney, Agent, or Firm* — Winston Hsu; Scott Margo

(57) ABSTRACT

A pipette includes a pipe. The pipe includes a connection end portion, an inner flow passage, and an outer flow passage surrounding the inner flow passage. The inner flow passage has a first opening portion and a second opening portion opposite to the first opening portion. The outer flow passage has a third opening portion and a fourth opening portion opposite to the third opening portion. The first opening portion and the third opening portion are disposed at the connection end portion. The second opening portion and the fourth opening portion are disposed at an interval. Thereby, the pipette according to the invention can provide two flowing paths with in a single member, so that in a washing process for a reaction tube, the pipette can be used for completing a plurality washing cycles with being inserted into the reaction tube only once.

7 Claims, 8 Drawing Sheets

PIPETTE

BACKGROUND OF THE INVENTION

1. Field of the Invention

The invention relates to a pipette, and especially relates to a pipette for washing a reaction tube.

2. Description of the Prior Art

Current automation of washing reaction tubes usually is performed through a work platform equipped with two sliding arms, each of which has an XY positioning mechanism and a Z positioning mechanism. Therein, one of the sliding arms is equipped with an adaptor for providing washing liquid, and the other one is equipped with an adaptor for drawing waste liquid. Each adaptor is sleeved with a common pipette for providing washing liquid or drawing waste liquid. In principle, injecting of the washing liquid and drawing of the waste liquid is performed separately for requirements for without pollutions on the reaction tubes. One injection of the washing liquid and one draw of the waste liquid are taken as a washing cycle. In general, the washing for the reaction tube needs three cycles. For meeting the requirement for without pollutions, at least the adaptor for drawing the waste liquid needs to use a new pipette every cycle so that no external pollutions get into the reaction tube that contains waste liquid to be drawn. Accordingly, the washing of the reaction tube includes a plurality of movements of the sliding arms and a plurality of operations of replacing pipettes, resulting in a longer washing time and a greater consumption of pipettes. Therefore, the current washing mechanism for reaction tubes can hardly reduce time cost and consumables cost.

SUMMARY OF THE INVENTION

An objective of the invention is to provide a pipette, which provides two paths through a single member. When the pipette is used in a washing process for a reaction tube, washing liquid and waste liquid can be injected and drawn respectively simultaneously, so that the movement time of the sliding arms and the replacement cost of the pipettes can be reduced.

A pipette according to the invention includes a pipe. The pipe includes a connection end portion, an inner flow passage, and an outer flow passage surrounding an inner flow passage. The inner flow passage has a first opening portion and a second opening portion opposite to the first opening portion. The outer flow passage has a third opening portion and a fourth opening portion opposite to the third opening portion. The first opening portion and the third opening portion are disposed at the connection end portion. The second opening portion and the fourth opening portion are disposed at an interval. Thereby, the pipette according to the invention can provide two flowing paths through a single member. Furthermore, the second opening portion and the fourth opening portion are separate, so that the two flowing paths will not interfere with each other. When used in a washing process for a reaction tube, the pipette is coupled through the connection end portion with an adaptor capable of providing washing liquid and drawing waste liquid. Then, a plurality of washing cycles can be performed by inserting the pipette into the reaction tube once. Compared with the prior art, for a washing process for one reaction tube (including three washing cycles), the pipette according to the invention just need one Compared with the prior art, just one pipette according to the invention is needed for a washing process for a reaction tube (i.e. including three washing cycles), so the consumables cost is reduced. Besides, the time cost is also reduced due to no need to change the pipette during the washing process.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
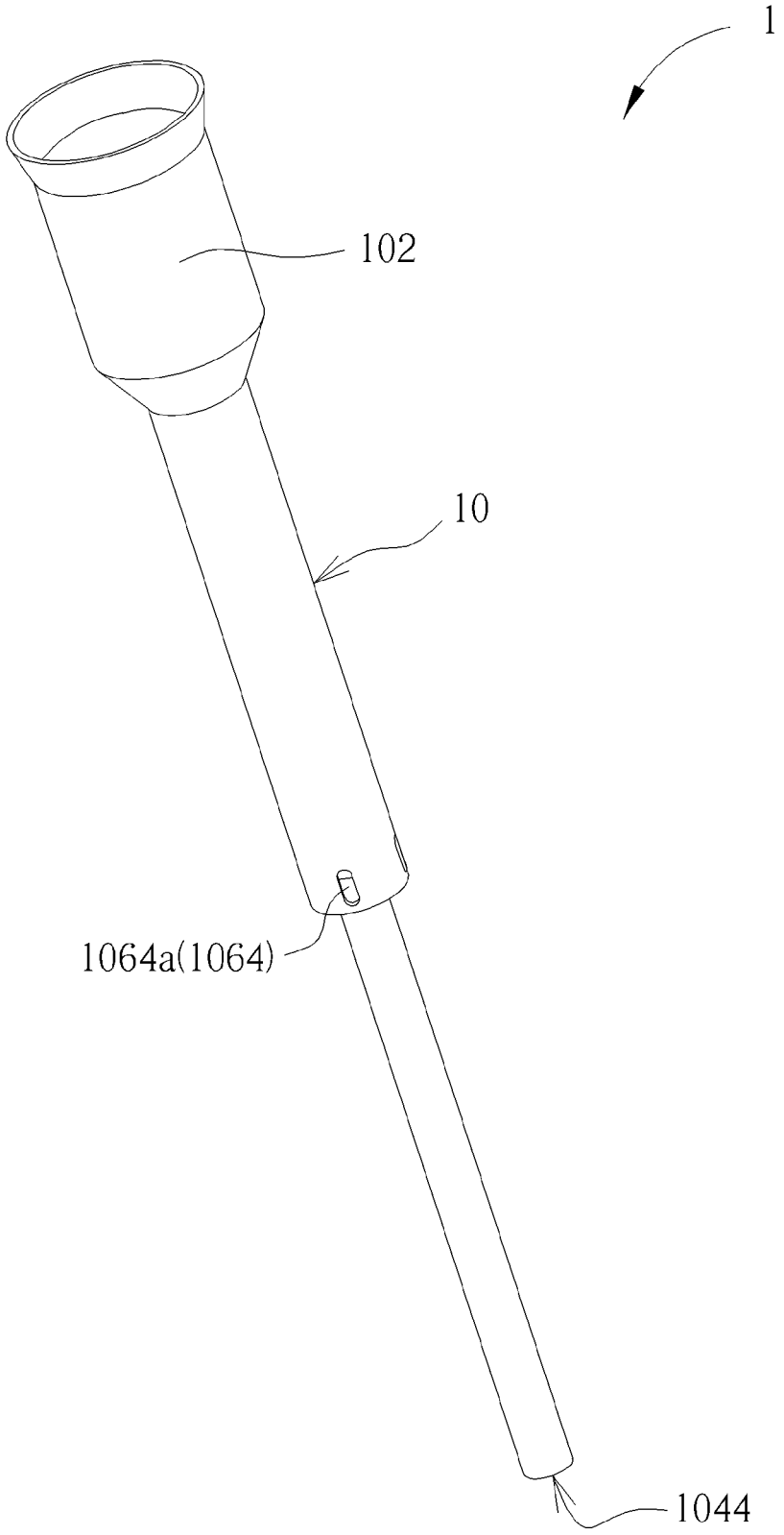
FIG. 1 is a schematic diagram illustrating a pipette of an embodiment according to the invention.
Figure 2:
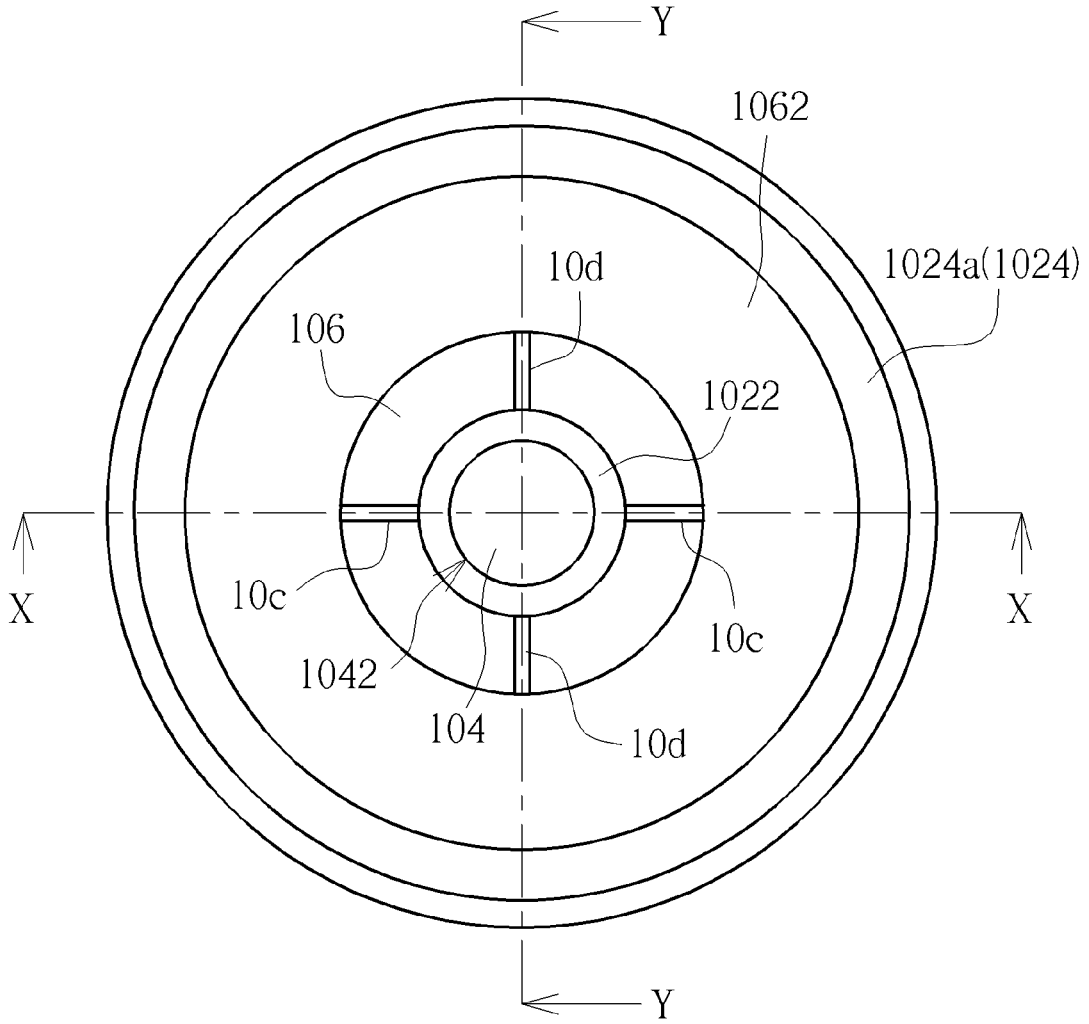
FIG. 2 is a top view of the pipette in FIG. 1.
Figure 3:
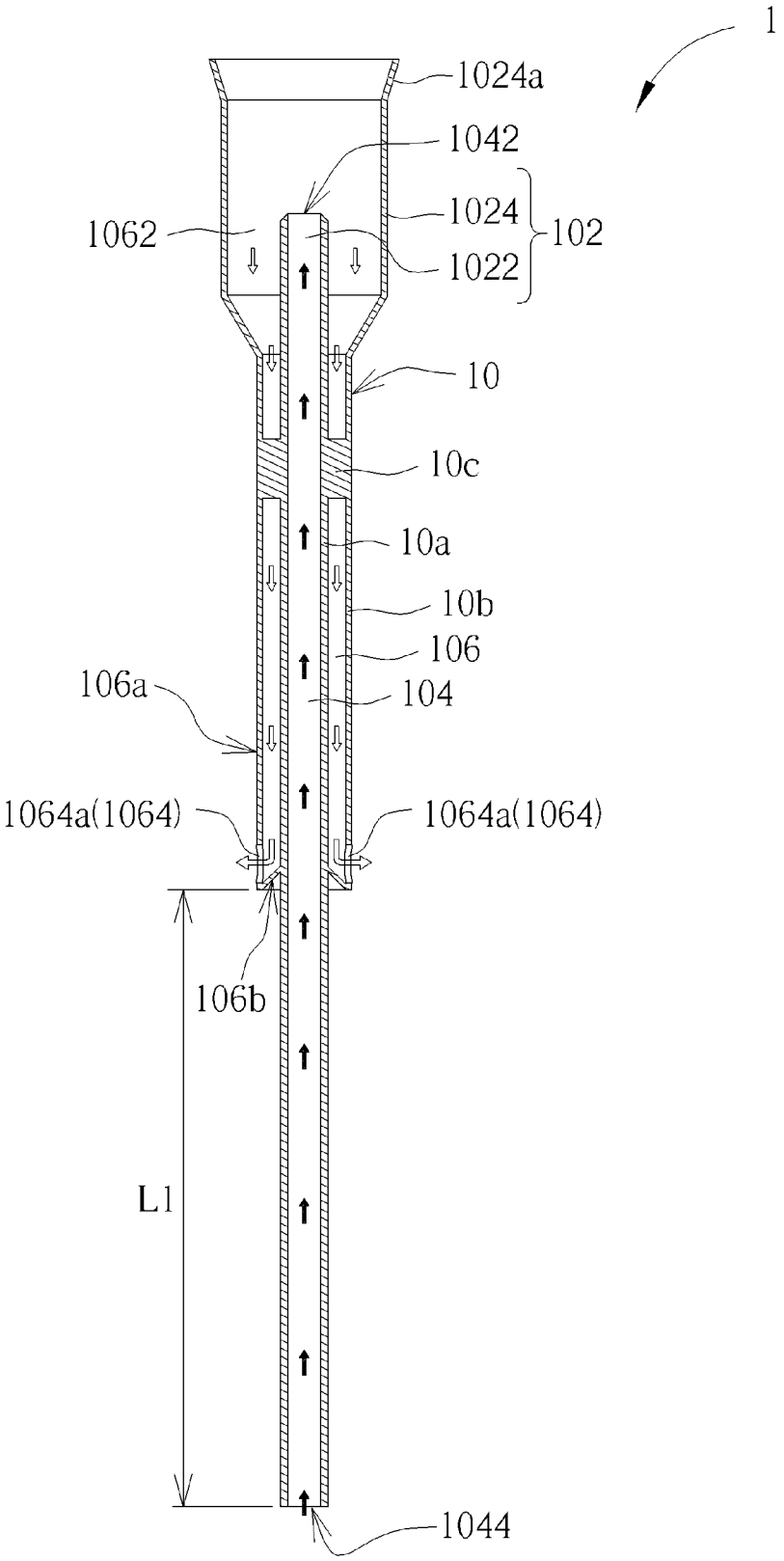
FIG. 3 is a sectional view of the pipette in FIG. 2 along the line X-X.
Figure 4:
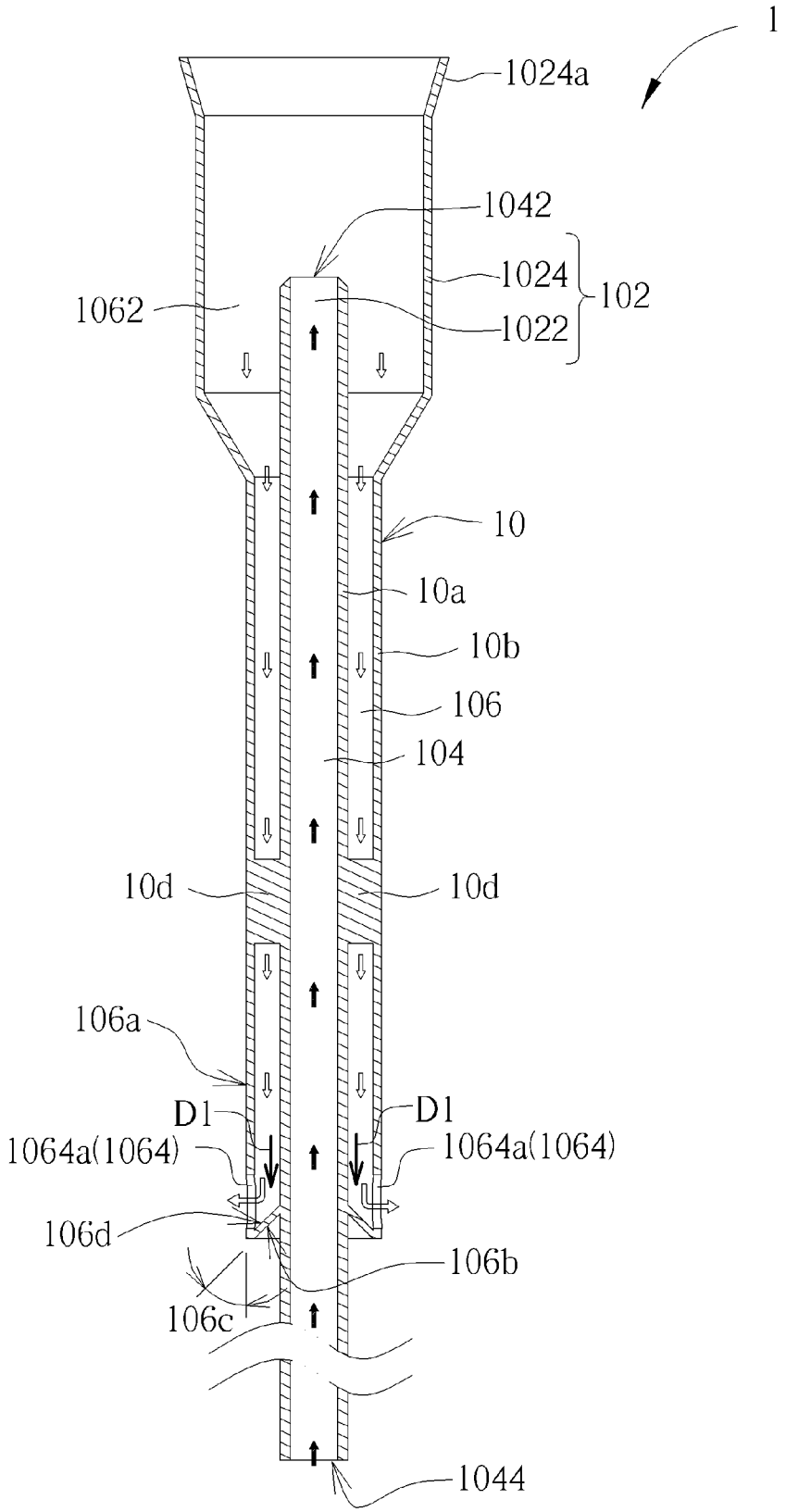
FIG. 4 is a sectional view of the pipette in FIG. 2 along the line Y-Y.
Figure 5:
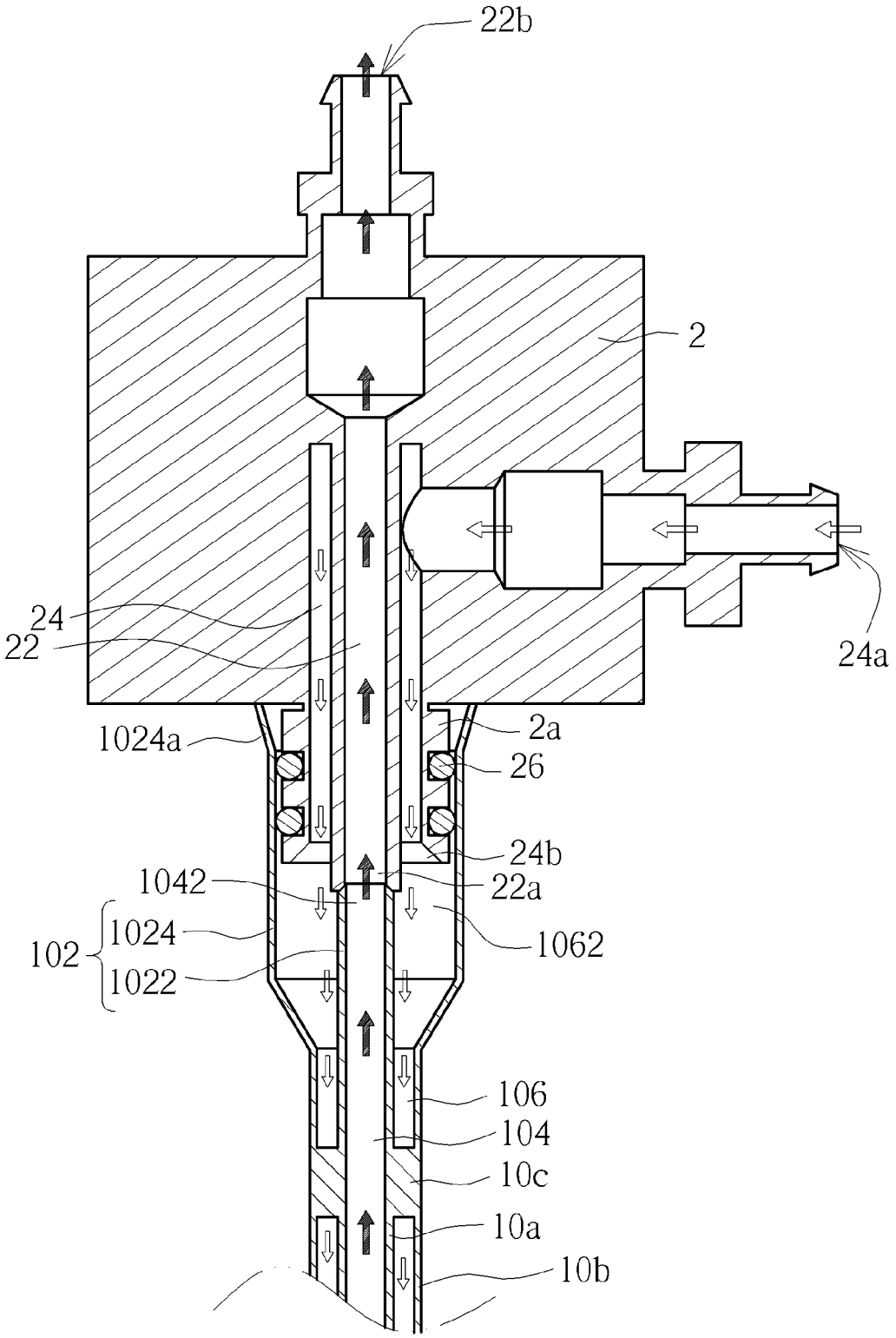
FIG. 5 is a sectional view of the pipette in FIG. 1 applied to an adaptor.

Please refer to FIGS. 1-5. FIG. 1 is a schematic diagram illustrating a pipette 1 of an embodiment according to the invention. FIG. 2 is a top view of the pipette 1. FIG. 3 is a sectional view of the pipette 1 along the line X-X in FIG. 2. FIG. 4 is another sectional view of the pipette 1 along the line Y-Y in FIG. 2. FIG. 5 is a sectional view of the pipette 1 that is applied to an adaptor 2. The pipette 1 includes a pipe 10. The pipe 10 includes a connection end portion 102, an inner flow passage 104 and an outer flow passage 106 surrounding the inner flow passage 104. The inner flow passage 104 has a first opening portion 1042 and a second opening portion 1044 opposite to the first opening portion 1042. The outer flow passage 106 has a third opening portion 1062 and a fourth opening portion 1064 opposite to the third opening portion 1062. The first opening portion 1042 and the third opening portion 1062 are disposed at the connection end portion 102. The second opening portion 1044 and the fourth opening portion 1064 are disposed at an interval L1. The adaptor 2 has a waste liquid inlet 22*a*, a waste liquid outlet 22*b* connected to the waste liquid inlet 22*a*, a washing liquid inlet 24*a*, and a washing liquid outlet 24*b* connected to the washing liquid inlet 24*a*. When in use, the pipette 1 is coupled with the adaptor 2 through the connection end portion 102, so that the first opening portion 1042 of the inner flow passage 104 is coupled with the waste liquid inlet 22*a* and the third opening portion 1062 of the outer flow passage 106 is coupled with the washing liquid outlet 24*b*. Thereby, the inner flow passage 104 is connected to a waste liquid channel 22 inside the adaptor 2, and the outer flow passage 106 is connected to a washing liquid channel 24 inside the adaptor 2. Therein, the determination of the interval L1 depends on the use condition of an applied case (e.g. washing a reaction tube). In general, the interval L1 is shorter than the depth of the reaction tube. For example, for different application cases, the interval L1 can be within a range from 5 mm to 100 mm.

Figure 6:
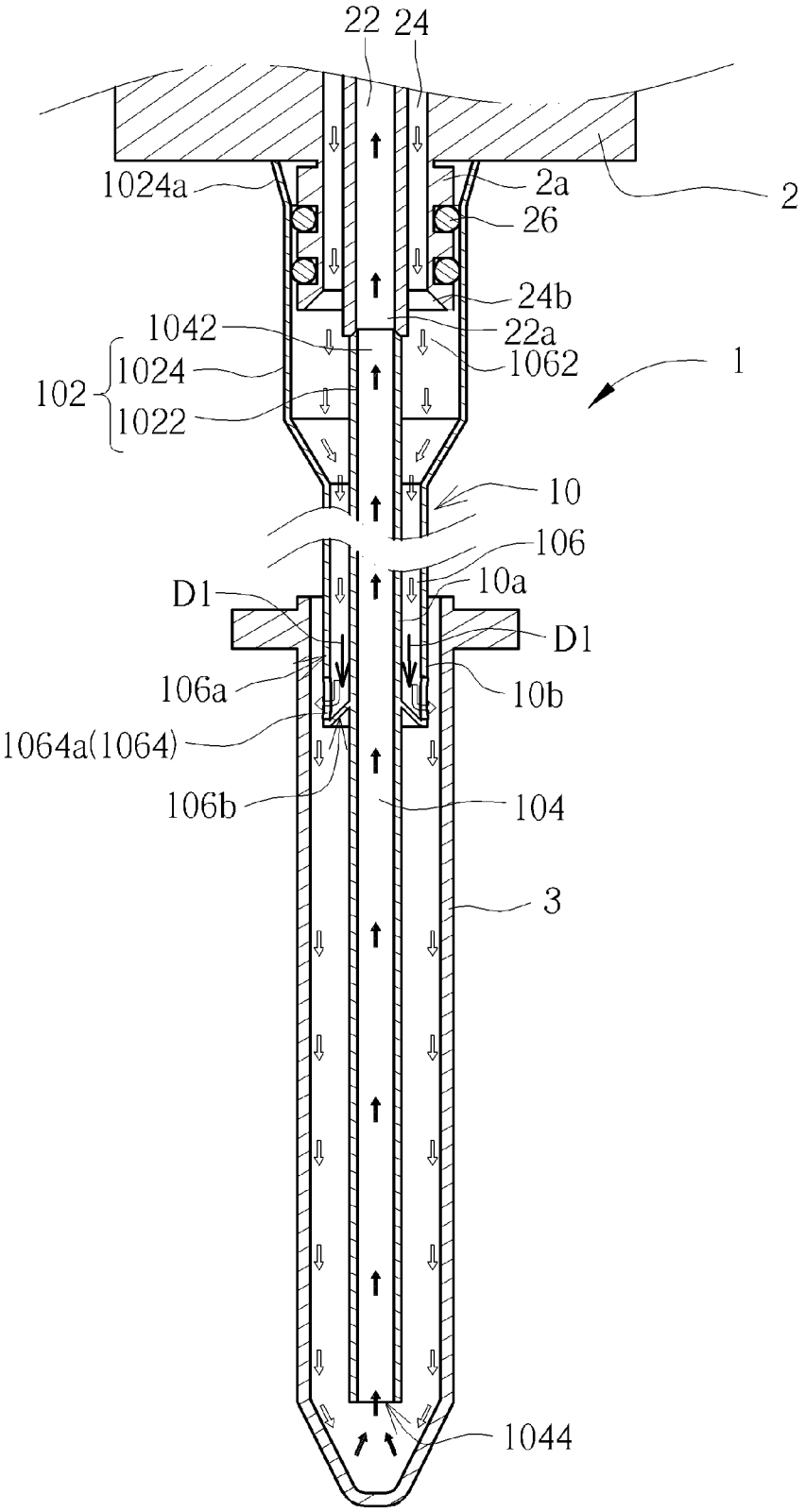
FIG. 6 is a sectional view of the pipette in FIG. 1 inserted into a reaction tube.

Furthermore, each of the inner flow passage 104 and the outer flow passage 106 forms a flowing path. In coordination with the flowing paths of the adaptor 2, the flowing path (indicated by solid arrows in the sectional views) of the inner flow passage 104 is located at the central portion of the pipe 10 while the flowing path (indicated by hollow arrows in the sectional views) of the outer flow passage 106 is located at the peripheral portion of the pipe 10. By the staggered disposition of the second opening portion 1044 and the fourth opening portion 1064, interference between the two flowing paths can be greatly reduced. Please also refer to FIG. 6. FIG. 6 is a sectional view of the pipette 1 inserted into a reaction tube 3. When the pipette 1 is in use, the washing liquid passes through the washing liquid inlet 24*a*, the washing liquid channel 24, the washing liquid outlet 24*b*, the third opening portion 1062, the outer flow passage 106, and the fourth opening portion 1064 to get in the reaction tube 3; the waste liquid (including liquid originally existing inside the reaction tube 3 and the washing liquid having entered the reaction tube 3) passes through the second opening portion 1044, the inner flow passage 104, the first opening portion 1042, the waste liquid inlet 22*a*, the waste liquid channel 22, and the waste liquid outlet 22*b* to be retrieved. In the embodiment, in coordination with the usage condition that the inner flow passage 104 connects with the waste liquid channel 22, the second opening portion 1044 protrudes out of the fourth opening portion 1064; i.e. in the view point of FIG. 6, the second opening portion 1044 is located relatively low. This configuration is conducive to an efficient retrieval of the waste liquid (including liquid originally existing inside the reaction tube 3 and the washing liquid having entered the reaction tube 3 from the fourth opening portion 1064). However, the invention is not limited thereto.

Furthermore, in the embodiment, the pipe 10 is a coaxial structure, so the outer flow passage 106 shows a hollow cylinder. The outer flow passage 106 has an extending direction D1 (indicated by a solid line segment with an arrow) at fourth opening portion 1064. The fourth opening portion 1064 includes a plurality of holes 1064*a* disposed outwards relative to the extending direction D1, so that the washing liquid substantially radially flows out the outer flow passage 106 from the holes 1064*a* relative to the extending direction D1 and flows down along the inner sidewall of the reaction tube 3. Furthermore, in the embodiment, the holes 1064*a* are disposed at the periphery at equal central angular intervals relative to the extending direction D1, which facilitates the washing liquid flowing in the reaction tube 3 uniformly and enhances the washing effect to the reaction tube 3.

Furthermore, in the embodiment, the outer flow passage 106 has an outer sidewall surface 106*a* and an outer end wall surface 106*b* connected to the outer sidewall surface 106*a*. The outer end wall surface 106*b* is a concave conical surface. The holes 1064*a* are located on the outer sidewall surface 106*a* close to the outer end wall surface 106*b*. By the design of the concave conical surface, if liquid spatters from the lower toward the fourth opening portion 1064, the liquid can be blocked by the outer end wall surface 106*b*; besides, by the effect of the geometric shape of the outer end wall surface 106*b* (i.e. the outer end wall surface 106*b* and the outer sidewall surface 106*a* connecting with each other to form an acute angle 106*c*), when the gravity of liquid adhering onto the outer end wall surface 106*b* increases, the liquid will flows to the edge (i.e. where the outer sidewall surface 106*a* and the outer end wall surface 106*b*) of the outer end wall surface 106*b* and drops, without spreading upward to the fourth opening portion 1064 to pollute the washing liquid. In practice, with a consideration to the adhesive force between the washing liquid and the outer sidewall surface 106*a*, the holes 1064*a* can be disposed a little away from the connection of the outer sidewall surface 106*a* with the outer end wall surface 106*b*, for further reducing the possibility that the liquid that has reached the edge of the outer end wall surface 106*b* pollutes the washing liquid. In addition, in the embodiment, the outer flow passage 106 has an inner end wall surface 106*d* opposite to the outer end wall surface 106*b*. The inner end wall surface 106*d* also shows a conical structure to provide a slanting surface relative to the extending direction D1 for the washing liquid that passes through the fourth opening portion 1064, so that after the liquid flowing out from the fourth opening portion 1064, a force of the liquid hitting the inner sidewall of the reaction tube 3 can be reduced so that the washing liquid can flow downward along the inner sidewall of the reaction tube 3 more smoothly. However, the invention is not limited thereto; for example, the inner end wall surface 106*d* is perpendicular to the extending direction D1.

It is added that in the embodiment, the outer end wall surface 106*b* is concave conical so as to prevent spattering liquid from polluting the washing liquid; however, the invention is not limited thereto. In principle, the washing liquid flows out of the outer flow passage 106 from the holes 1064*a*, so preventing the liquid adhering on the outer end wall surface 106*b* from approaching the hole 1064*a* can efficiently reduce the pollution in the washing liquid. Thereby, in practice, it is practicable to form an acute angle where portions of the outer end wall surface 106*b* close to the holes 1064*a* is connected with the outer sidewall surface 106*a*, and the other portions of the outer end wall surface 106*b* can be connected with the outer sidewall surface 106*a* in a rectangular or obtuse angle.

Figure 7:
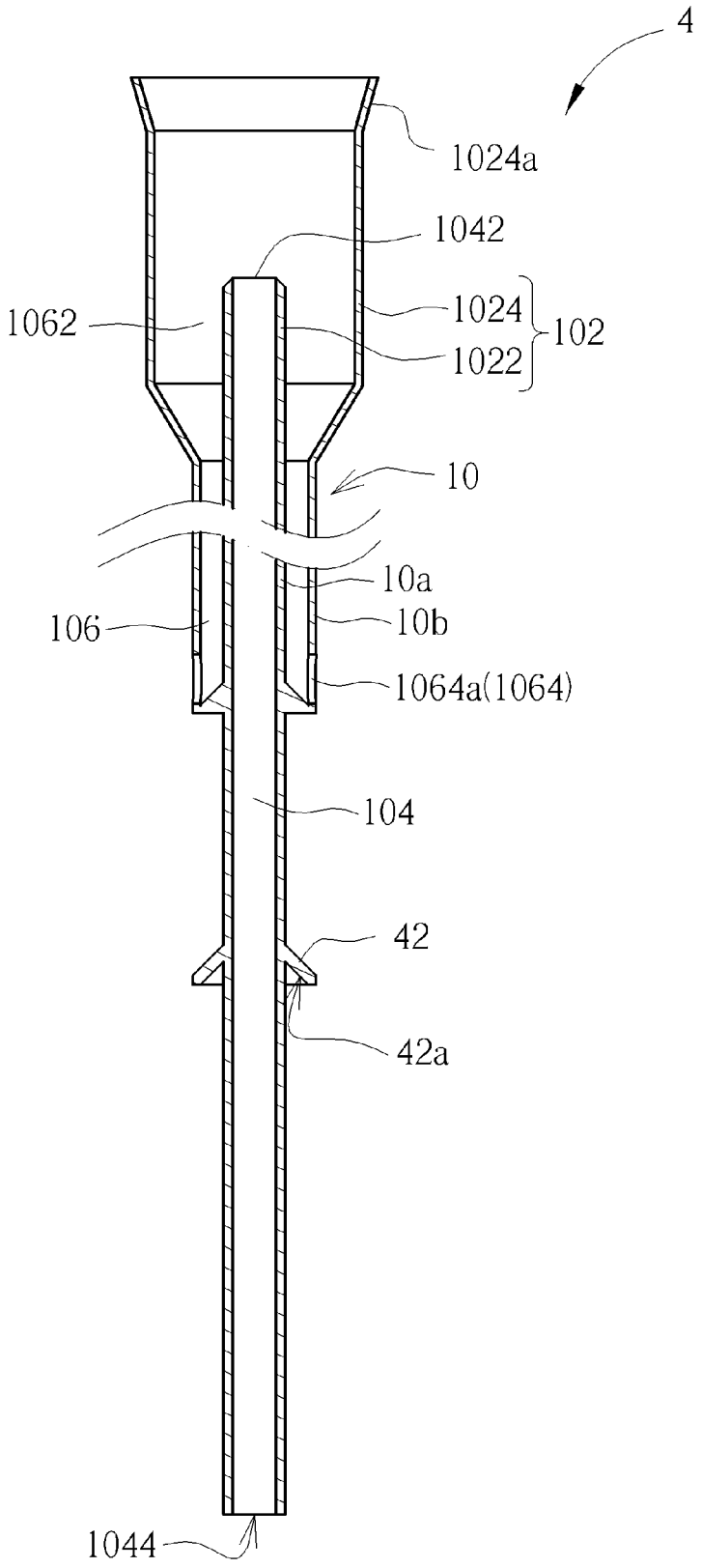
FIG. 7 is a sectional view of a pipette of another embodiment according to the invention.

It is added more that in the embodiment, the voidance of pollution in the washing liquid induced by liquid spattering is achieved by the outer end wall surface 106*b* of the outer flow passage 106; however, the invention is not limited thereto. Please refer to FIG. 7, which is a sectional view of a pipette 4 of another embodiment according to the invention. The pipette 4 is substantially structurally equal to the pipette 1, so the pipette 4 uses the same reference numbers as the pipette 1. For other descriptions of the pipette 4, please refer to the relevant descriptions of the components of the pipette 1 notated with the same reference numbers, which will not be repeated in addition. A difference between the pipette 4 and the pipette 1 is that the pipette 4 includes a block portion 42 which is disposed between the second opening portion 1044 and the fourth opening portion 1064 and also can prevent the waste liquid below spattering upwards from polluting the washing liquid from the fourth opening portion 1064. Further, the block portion 42 has a concave conical surface 42*a* surrounding the sidewall of the inner flow passage 104 toward the second opening portion 1044. The concave conical surface 42*a* has the same function as the concave conical outer end wall surface 106*b*, which will not be repeated in addition. In another aspect, in the pipette 1, the concave conical outer end wall surface 106*b* is equal to the block portion 42 in logic.

Please refer to FIGS. 1 to 6. In the embodiment, the connection end portion 102 includes an inner ring wall 1022 and an outer ring wall 1024 surrounding the inner ring wall 1022. The first opening portion 1042 is formed inside the inner ring wall 1022. The third opening portion 1062 is formed between the inner ring wall 1022 and the outer ring wall 1024. The adaptor 2 has a protruding connection port 2*a*, of which the waste liquid inlet 22*a* is located at the central portion and the washing liquid outlet 24*b* is located at the peripheral portion. When the connection end portion 102 is coupled with the adaptor 2, the outer ring wall 1024 tightly sleeves on the connection port 2*a* of the adaptor 2 (for example with a O-ring 26 disposed therebetween), and the first opening portion 1042 tightly abuts against the waste liquid inlet 22*a* (in practice, may be by an additional structure for coupling the first opening portion 1042 with the waste liquid inlet 22*a* more tightly).

Therein, the outer ring wall 1024 tightly sleeves on the connection port 2*a* and the first opening portion 1042 tightly abuts against the waste liquid inlet 22*a*, so the coupling of the third opening portion 1062 with the washing liquid outlet 24*b*. Furthermore, in the embodiment, the outer ring wall 1024 has a bell mouth 1024*a*, which is conducive to the insertion of the connection port 2*a* into the connection end portion 102.

In the above embodiments, the pipe 10 is realized by a coaxial structure, substantially consisting of an inner tube 10*a* and an outer tube 10*b* surrounding the inner tube 10*a* (or the inner tube 10*a* passing through the outer tube 10*b*). A passage formed inside the inner tube 10*a* serves as the inner flow passage 104; a passage formed between the outer tube 10*b* and the inner tube 10*a* (i.e. bounded by the outer surface of the inner tube 10*a* and the inner surface of the outer tube 10*b*) serves as the outer flow passage 106. As a whole, the inner flow passage 104 and the outer flow passage 106 extend in the same axis direction that is equal to the extending direction D1 in the embodiment. Furthermore, for enhancing the structural strength of the outer tube 10*b* and the inner tube 10*a*, the pipe 10 includes a plurality of ribs 10*c*-10*d*, connecting to the outer tube 10*b* and the inner tube 10*a* in different heights. The invention is, however, not limited thereto. For example, the outer tube 10*b* and the inner tube 10*a* are disposed to be eccentric, which also can form an inner flow passage substantially at the central portion and an outer flow passage surrounding the inner flow passage. For another example, a bundle of pipes is used so that in the sectional view thereof, the pipes at the central portion serve as an inner flow passage, and the pipes at the peripheral portion serve as an outer flow passage; therein, an end of the bundle forms a first opening portion of the inner flow passage and a third opening portion of the outer flow passage in a structural integration way or through an additional component, so that the end of the bundle can be coupled with the adaptor 2. For another example, the pipe 10 can still be realized by a coaxial structure but not extends along a straight path.

Figure 8:
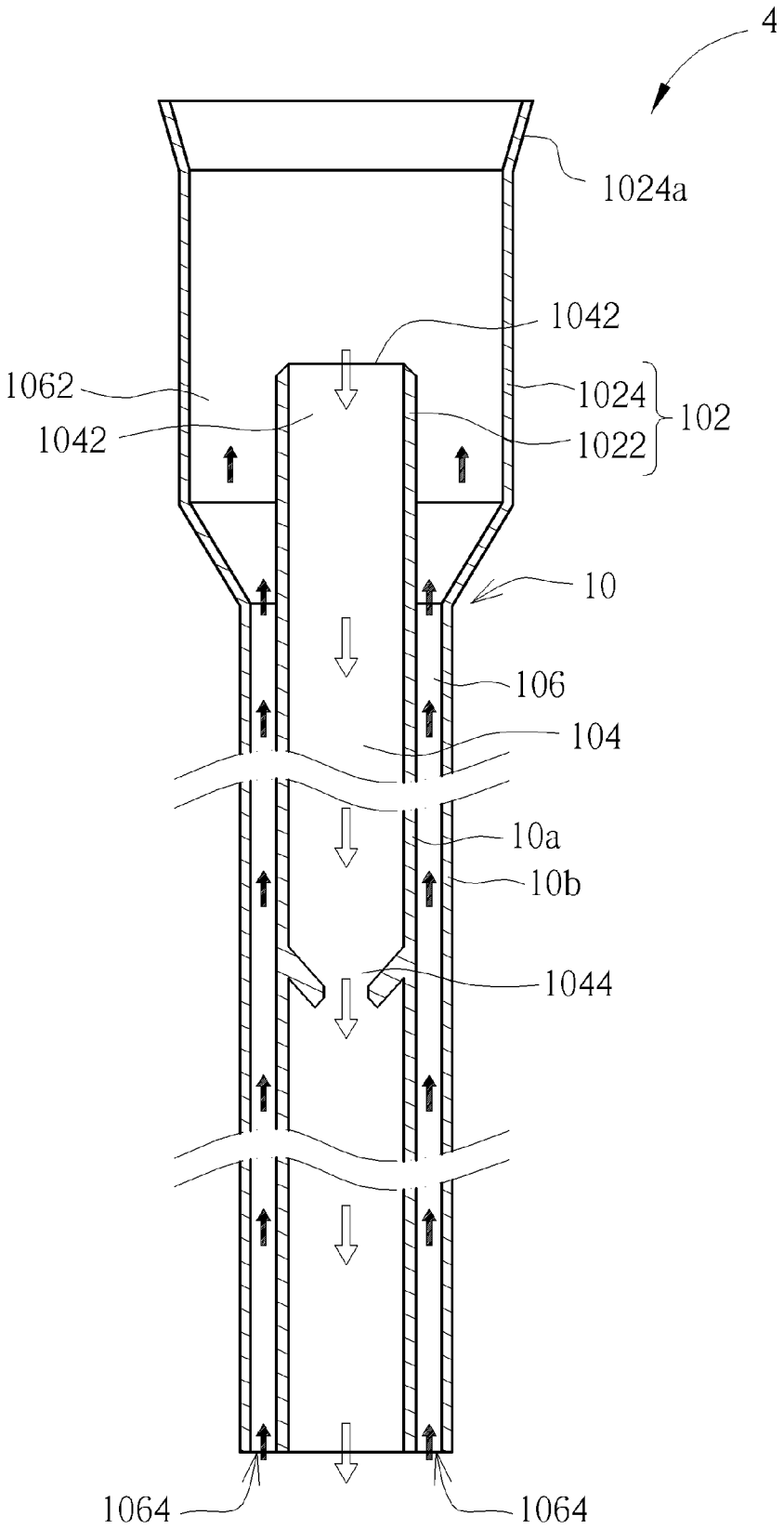
FIG. 8 is a sectional view of a pipette of another embodiment according to the invention.

In addition, the above embodiments are based on a condition that the second opening portion 1044 protrudes out the fourth opening portion 1064, but the invention is not limited thereto. Please refer to FIG. 8, which is a sectional view of a pipette 5 of an embodiment according to the invention. The pipette 5 is substantially equal to the pipette 1 in structural logic, so the pipette 5 uses the same reference numbers as the pipette 1. For other descriptions of the pipette 5, please refer to the relevant descriptions of the components of the pipette 1 notated with the same reference numbers, which will not be repeated in addition. A difference between the pipette 5 and the pipette 1 is that in the pipette 5, the fourth opening portion 1064 protrudes out the second opening portion 1044. Therefore, in the embodiment, the inner flow passage 104 is used for the washing liquid, and the outer flow passage 106 is used for the waste liquid. In another aspect, when the pipette 5 is in use, the flowing paths of the inner flow passage 104 and the outer flow passage 106 are different to the flowing paths of the pipette 1. Accordingly, the adaptor 2 (referring to FIG. 5) is modified so that the channel 22 serves as a washing liquid channel, and the channel 24 serves as a waste liquid channel, which can be realized by washing the adaptor 2 and switching flowing paths (i.e. the flowing paths connected to the adaptor 2) for example. In this case, the structural connection of the connection end portion 102 of the pipette 5 with the connection port 2*a* of the adaptor 2 still can be the same as that of the pipette 1 with the adaptor 2. In practice, it is acceptable to modify the structure design of the connection end portion 102 of the pipette 5, so that the inner flow passage 104 of the pipette 5 still can connect with the channel 22 and the outer flow passage 106 still can connect with the channel 24, which can avoids an operation of re-setting the channels of the adaptor 2.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pipette, comprising:

a pipe, comprising a connection end portion, an inner flow passage, and an outer flow passage surrounding an inner flow passage, the inner flow passage having a first opening portion and a second opening portion opposite to the first opening portion, the outer flow passage having a third opening portion and a fourth opening portion opposite to the third opening portion, the first opening portion and the third opening portion being disposed at the connection end portion, the second opening portion and the fourth opening portion being disposed at an interval, the second opening portion protruding from the fourth opening portion, the outer flow passage having an extending direction at the fourth opening portion, the fourth opening portion comprising a plurality of holes disposed outwards relative to the extending direction, the outer flow passage having an outer sidewall surface and an outer end wall surface, the outer end wall surface and the outer sidewall surface connecting to form an acute angle.

2. The pipette of claim 1, wherein the outer end wall surface is a concave conical surface, and the plurality of holes are located on the outer sidewall surface close to the outer end wall surface.

3. The pipette of claim 1, further comprising a block portion disposed between the second opening portion and the fourth opening portion.

4. The pipette of claim 3, wherein the block portion has a concave conical surface surrounding the inner flow passage and facing the second opening portion.

5. The pipette of claim 1, wherein the connection end portion comprises an inner ring wall and an outer ring wall surrounding the inner ring wall, the first opening portion is formed inside the inner ring wall, and the third opening portion is formed between the inner ring wall and the outer ring wall.

6. The pipette of claim 1, wherein the pipe is a coaxial structure.

7. The pipette of claim 1, wherein the interval is within a range from 5 mm to 100 mm.

* * * * *